US005209836A

United States Patent [19]

Ford et al.

[11] Patent Number: 5,209,836

[45] Date of Patent: May 11, 1993

[54] BASEPLATE FOR ELECTROLYTIC CELL WITH A LIQUID METAL CATHODE

[75] Inventors: James M. Ford; Sanders H. Moore; David W. Cawlfield, all of Cleveland, Tenn.

[73] Assignee: Olin Corporation, Cheshire, Conn.

[21] Appl. No.: 810,059

[22] Filed: Dec. 19, 1991

[51] Int. Cl.[5] ..... C25B 1/40; C25B 9/00

[52] U.S. Cl. ..... 204/251

[58] Field of Search ..... 204/219-220, 204/251, 250

[56] References Cited

U.S. PATENT DOCUMENTS

| | | | |
|---|---|---|---|
| 727,025 | 5/1903 | Tafel | 204/101 |
| 918,370 | 4/1909 | Rink | 204/220 |
| 2,230,023 | 1/1941 | Aten | 204/219 |
| 2,242,477 | 5/1941 | Osswald et al. | 204/101 |
| 2,688,594 | 9/1954 | Oosterman | 204/251 X |
| 2,749,301 | 6/1956 | Rosenbloom | 204/251 |
| 4,101,407 | 7/1978 | Hilaire et al. | 204/251 |
| 4,586,994 | 5/1986 | Samejima et al. | 204/251 X |
| 4,849,073 | 7/1989 | Dotson et al. | 204/101 |

OTHER PUBLICATIONS

Article entitled "Hydroxylamine Production by Electroreduction of Nitric Oxide in a Trickle Bed"-*The Canadian Journal of Chemical Engineering*, vol. 57, Oct., 1979.

*Primary Examiner*—Donald R. Valentine

*Attorney, Agent, or Firm*—H. Samuel Kieser; Ralph D'Alessandro; F. A. Iskander

[57] ABSTRACT

An electrochemical cell is disclosed having a cell bottom or baseplate that has at least one drain hole therein which is fed by drain canals adjacent an end of the catholyte chamber such that the drain holes are gradually inclined to increase in depth laterally downwardly from the opposing sides of the cell toward the center and longitudinally downwardly from the opposing end of the cell toward the drain hole to permit removal or the addition of the liquid metal cathode from the angled electrolytic cell without requiring disassembly of the cell.

23 Claims, 2 Drawing Sheets

BASEPLATE FOR ELECTROLYTIC CELL WITH A LIQUID METAL CATHODE

BACKGROUND OF THE INVENTION

The U.S. Government has rights in this invention pursuant to Contract No. DAAA 15-89-C-0011 awarded by the Department of Army. Under this contract, the U.S. Government has certain rights to practice or have practiced on its behalf the invention claimed herein without payment of royalties.

The present invention relates to an electrochemical cell for use in the production of organic or inorganic chemicals. More particularly, the present invention relates to the baseplate design which permits a change in the level of the liquid metal cathode in the electrochemical cell designed for use in the production of aqueous solutions of hydroxylamine nitrate and other inorganic or organic chemicals using electrochemical reduction at a liquid metal surface.

Hydroxylamine nitrate is employed in the purification of plutonium metal, as one component of a liquid propellant, and as a reducing agent in photographic applications. In some of these applications a highly pure form of the compound is required.

Previous electrolytic processes have electrolyzed nitric acid solutions containing mineral acids such as sulfuric acid or hydrochloric acid to form hydroxylamine salts of these acids. The processes were carried out in an electrolytic cell having high hydrogen overvoltage cathodes, such as mercury or an alkali metal amalgam, with a diaphragm or membrane separating the cathode from the anode.

The hydroxylamine salt produced by the electrolytic processes of the prior art can be converted to hydroxylamine nitrate at low solution strength and in an impure state. One method is by electrodialysis as taught by Y. Chang and H.P. Gregor in Ind. Eng. Chem. Process Des. Dev. 20, 361-366 (1981). The double displacement reaction employed requires an electrochemical cell having a plurality of compartments and requiring both anion exchange and cation exchange membranes or bipolar membranes with significant capital costs and high energy costs.

U.S. Pat. No. 4,849,073 issued Jul. 18, 1989 and assigned to the assignee of the present invention disclosed a process and electrochemical cell to directly produce a concentrated hydroxylamine nitrate solution. A mercury cathode was used on top of a conductive plate that was also the top of the cooling compartment. This design entailed the use of additional space for the separate cooling compartment and did not provide against the possible loss of the mercury-containing cathode from the cell.

Electrolytic cell designs using liquid mercury cathodes have long been employed to produce chlorine and caustic in what are known as chlor-alkali cells. In these chlor-alkali cells, the mercury amalgam containing sodium metal is removed to make the product caustic by a secondary reaction in what is known as a "decomposer". In the instant process to produce the hydroxylamine nitrat2, the continuous removal of the mercury from the cell is both unnecessary and undesirable.

It may be necessary, however, to either remove all of the liquid metal cathode, such as mercury, from the catholyte compartment in the cell or to adjust its height level by adding or removing some of the liquid metal cathode material from the compartment. Since the cell of the present design optimally is operated on a slight angle from the horizontal, in the event of the need to entirely drain the liquid metal cathode, some provision must be made to remove all of the liquid from the base or low end of the cell.

These and other problems are solved by the design of the present invention whereby an electrochemical cell that has a continuous single cell bottom extending along the entire length of the catholyte compartment and into the end boxes is provided with drain holes and drain canals sufficient to permit an increase or decrease in the depth of the liquid metal cathode by the addition or removal of liquid metal cathode material through the drain holes. Where the liquid metal cathode must be removed entirely from the cell, the drain holes are fed by drain canals that are gradually inclined to increase in depth so that they start even with the cell bottom top surface and run at a downwardly sloping angle toward the drain holes to promote the downward flow of the liquid metal cathode out of the cell.

SUMMARY OF THE INVENTION

It is an object of the present invention to provide an improved cell bottom or baseplate in an angled electrolytic cell with a flowable liquid metal cathode to permit adjustment of the level of the liquid metal cathode by either addition or removal of the liquid metal from the catholyte chamber.

It is another object of the present invention to provide an improved cell bottom or baseplate that permits substantially all of the liquid metal cathode to be drained from the catholyte chamber while the cell is in its angled position from the horizontal.

It is a feature of the present invention that the cell is operated while angled on a grade of less than about 5 percent, preferably less than about 3 percent and more preferably less than about 1 percent from the horizontal.

It is another feature of the present invention that a plurality of drain holes are provided in the cell baseplate to permit access to the liquid metal cathode at various locations in the cathode compartment.

It is a further feature of the present invention that the drain holes adjacent the ends of the catholyte chamber have drain canals in fluid flow communication therewith that are gradually inclined to increase in depth so as to feed essentially from the generally flat top surface of the baseplate at an angle downwardly into the drain holes.

It is still another feature of the present invention that the drain canals run both laterally from the opposing sides of the cell and longitudinally from the opposing ends of the cell toward the drain holes.

It is yet another feature of the present invention that the improved cell baseplate or bottom is one piece and extends across the entire length of the catholyte chamber into the end boxes to provide a common cell bottom.

It is an advantage of the present invention that the level of the liquid metal cathode in the catholyte compartment can be adjusted by adding or removing cathode material through the drain holes without disassembling the entire cell.

It is another advantage of the present invention that the liquid metal cathode may be drained entirely from the catholyte chamber through the use of the drain canals and drain holes to remove substantially all of the liquid metal cathode material even from the lower angled side of the catholyte chamber.

It is a further advantage of the present invention that the one piece cell bottom provides a simpler and more economical cell design.

It is still another advantage of the present invention that one or more of the drain holes can be used to receive inserted instrument probes, such as, for example, a temperature probe to measure the temperature of the catholyte or the cathode in the catholyte compartment or a level probe to measure the depth of the liquid metal cathode.

These and other objects, features and advantages are provided in the cell bottom design of the present invention by utilizing at least one drain hole in the baseplate of the cell that is fed by drain canals adjacent an end of the catholyte chamber such that the drain canals are gradually inclined to increase in depth laterally downwardly from the opposing sides of the cell toward the center and longitudinally downwardly from the opposing end of the cell toward the drain hole to permit removal of substantially all of the liquid metal cathode material from the angled electrolytic cell or to permit the depth of the liquid metal cathode to be adjusted by selective removal or addition of liquid metal cathode material.

BRIEF DESCRIPTION OF THE DRAWINGS

The advantages of this invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
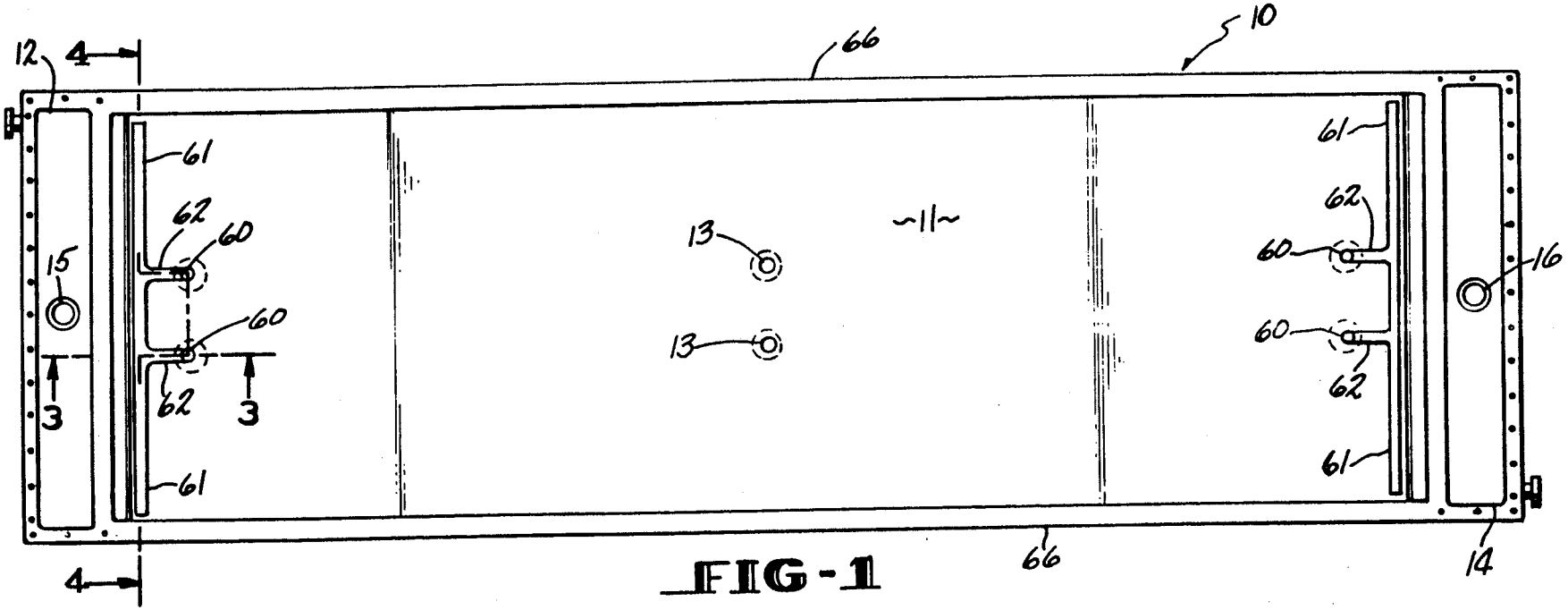
FIG. 1 is a top plan view of the electrochemical cell showing the cell baseplate extending from the catholyte end boxes through the catholyte chamber with a plurality of drain holes and drain canals therein and the cathode side and end frames mounted thereto.

FIG. 1 shows the cell bottom 11 of the electrolytic cell 10 used to produce desired chemicals employing an electrochemical reduction at the surface of a flowable liquid metal cathode. As seen in FIG. 1, the cathode inlet end box 12 and the cathode outlet end box 14 are shown in the lengthwise configuration of cell with a catholyte inlet feed pipe or header 15 and a catholyte outlet pipe or header 16 shown exiting their respective end boxes.

Figure 2:
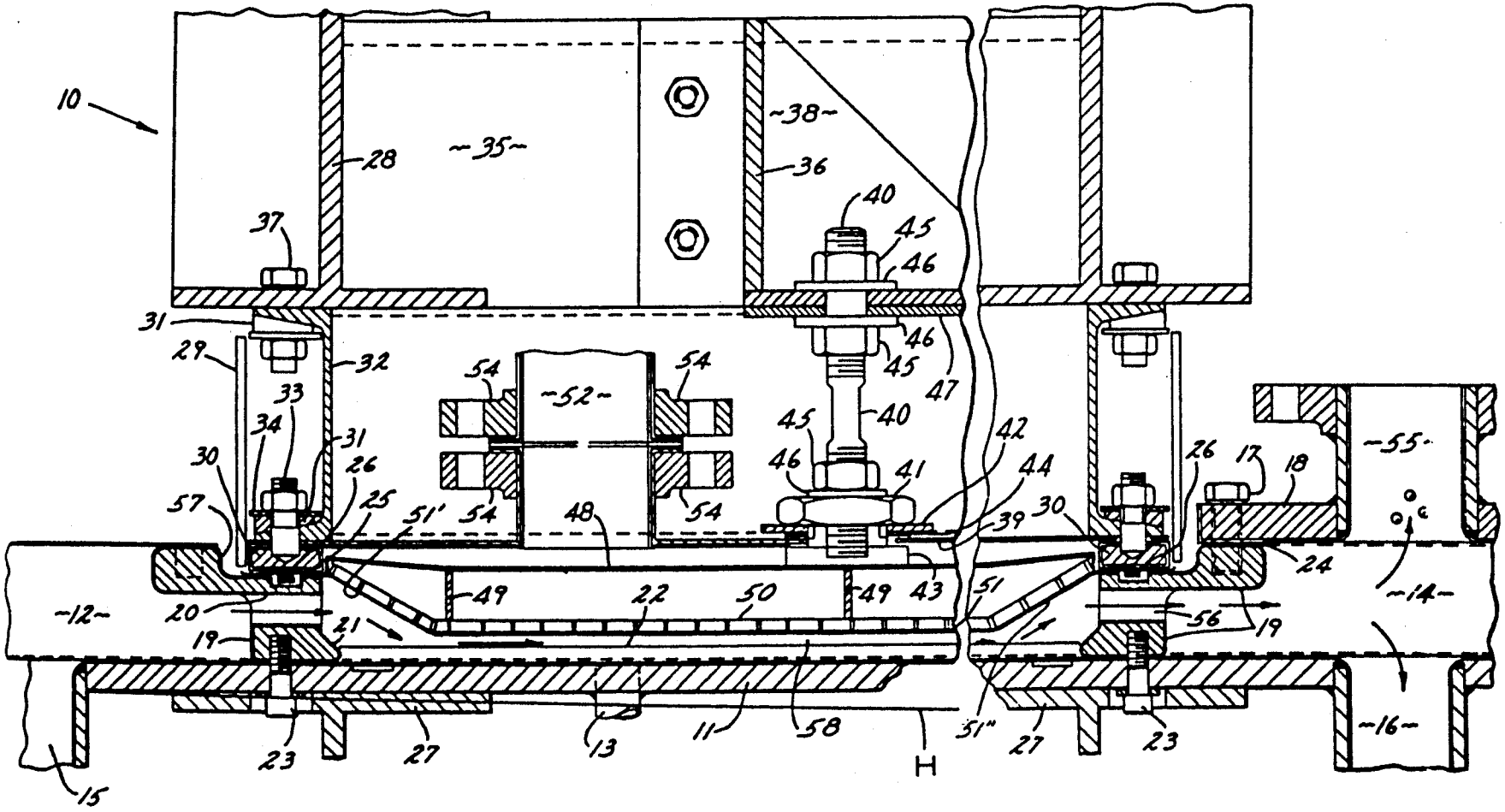
FIG. 2 is a side sectional elevational view of the cells showing the catholyte flow pattern from the inlet side through the outlet side of the cell.

The sectional view through the cell shown in side elevational fashion in FIG. 2 illustrates the catholyte flow pattern. As seen in FIG. 2 the catholyte enters and exits the catholyte compartment in the cell 10 at a level above the major portion of the membrane 51 and is positioned across an extended plane between the lower first inlet end passage 20 and the opposing higher second outlet end passage 56. Catholyte is fed into the cathode inlet end box 12 via an appropriate fitting, such as the catholyte inlet feed pipe 15 and passes through the cathode side frame 19 via the lower first inlet end passage 20 into the gap 58 in the cathode compartment between the surface of the liquid metal cathode 22 and the cation permselective membrane 51. The gap 58 between the membrane 51 and the surface of the liquid metal cathode 22 is between about 5 to about 15 millimeters, more preferably is about 6 to about 13 millimeters, and most preferably is between about 7 to about 11 millimeters. The membrane 51 is held against the woven wire screen mesh anode 50 by differential pressure. This differential pressure, which can vary from as little as about 0.1 to as much about 4.0 pounds per square inch, creates a generally uniform flow gap between the membrane 51 and the liquid metal cathode 22.

The anode can have a screen mesh welded to rods or members which can be made from tantalum or niobium. The mesh can be made from any noble metal or noble metal oxide coated on a substrate and, more preferably, a platinum clad niobium. Preferably the platinum is coextruded over a niobium wire.

A wide variety of cation exchange membranes can be employed containing a variety of polymer resins and functional groups, provided the membranes possess the requisite anion and gas selectivity, as well as preventing or minimizing the passage of excessive amounts of water from the anode compartment into the cathode compartment. Suitable cation exchange membranes are those which are inert, flexible, and are substantially impervious to the hydrodynamic flow of the electrolyte and the passage of any gas products produced in the anode compartment. Cation exchange membranes are well-known to contain fixed anionic groups that permit the intrusion and exchange of cations, and exclude anions, from an external source. Generally the resinous membrane or diaphragm has as a matrix a cross-linked polymer to which are attached charged radicals, such as $-SO_3^{=}$, $-COO^{-}$, $-PO_3^{=}$, $-HPO_2^{=}$, $-AsO_3^{=}$, and $-SeO_3-$ and mixtures thereof. The resins which can be used to produce the membranes include, for example, fluorocarbons, vinyl compounds, polyolefins, and copolymers thereof. Preferred are cation exchange membranes such as those comprised of fluorocarbon polymers having a plurality of pendant sulfonic acid groups or carboxylic acid groups or mixtures of sulfonic acid groups and carboxylic acid groups. The terms "sulfonic acid group" and "carboxylic acid groups" are meant to include salts of sulfonic acid or salts of carboxylic acid groups. Suitable cation exchange membranes are sold commercially by E.I. DuPont de Nemours & Co., Inc. under the trademark "NAFION", by the Asahi Glass Co. under the trademark "FLEMION", and by the Asahi Chemical Co. under the trademark "ACIPLEX".

The major portion of the membrane that is stretched across an extended plane between the lower first inlet end passage 20 and the opposing higher second outlet end passage 56 is illustrated by the numeral 51, while the obliquely angled portions of the membrane supported against the anode woven mesh screen mesh 50 adjacent the end boxes 12 and 14 on opposing sides of the cell 10 are indicated as 51'.

As best seen in FIG. 2, the catholyte enters through the side frame 19 via the lower first inlet end passage 20 and flows across the surface of the liquid metal cathode 22 beneath the membrane portions 51' and 51 until it exits the opposing higher outlet end 56. The flow rate of the catholyte across the liquid metal cathode is sufficient to maintain the temperature of the electrolytic cell 10 at a level to permit the product specific reactions to occur and to prevent product decomposition from occurring within the cell. The catholyte, upon leaving the cell 10 via the catholyte outlet 16 in end box 14, is circulated to a heat exchanger or chiller (not shown) to reduce the temperature to about 10° C. The flow rate of the catholyte required will depend upon the heat generated by the kiloampere current load at which the cell 10 is operated.

Further, the velocity of the catholyte increases in the area of the extended plane of the membrane 51. The velocity of the catholyte flow across the cathode compartment must increase in larger commercial scale cell designs to maintain the desired electrolyte residence time in the cell without creating turbulent flow conditions that will break up the liquid metal cathode and carry it out of the cathode compartment of the cell.

In the instant design, it is critical that the force of the catholyte flowing through the cell directed toward the outlet end passage 56 of the cell is exactly counterbalanced by the force of the liquid metal directed toward the inlet end passage 20 of the cell 10 and is proportional to the difference in height between the exit and the inlet ends of the cell and the density of the liquid metal cathode. As seen in FIG. 2, the cell 10 is angled from the horizontal, which is indicated generally by the line designated H. Since the angle or tilt of the cell and the flow rate of the catholyte through the gap 58 between the membrane and the liquid metal cathode 22 are interrelated, one or both may have to be adjusted to maintain the parallel relationship of the surface of the liquid metal cathode 22 and the membrane portion 51. The tilting of the entire cell permits the liquid metal cathode to remain at a generally static level in the catholyte chamber and maintain the surface of the major portion of the membrane and the surface of the liquid metal cathode as generally parallel. This particular configuration and flow velocity of the catholyte also permit any gas bubbles generated during electrolysis to be carried by the channel flow pattern from the inlet end passage 20 and through the outlet end passage 56 into the outlet end box 14 of the cell.

It is theorized that the flow pattern and velocity of the catholyte creates an almost circular flow pattern within the liquid metal cathode 22 that causes the top surface of the liquid metal cathode 22 to move from the inlet end passage 20 toward the outlet end passage 56 because of the drag created on the top layer of the liquid metal cathode 22 while the bottom of the liquid metal cathode 22 moves in the opposite direction, flowing down the angled cell bottom 11 toward the inlet end passage 20.

The catholyte is force flow circulated through the gap 58 in the catholyte compartment in the cell 10 at a flow rate of between about 75 to about 150 gallons per minute which produces a catholyte flow rate through the gap 58 of between about 1 to about 5 cubic meters per hour per square meter of cathode surface area and an average bulk flow velocity of about 0.1 to about 2 meter per second squared.

This flow rate produces a flow pattern in the liquid metal cathode in which there are small waves that are choppy and move in multiple directions within the catholyte compartment, but no liquid metal is entrained in the outlet end passage 56. This is in contrast to a fully turbulent flow pattern where the waves of the liquid metal would be carried out and exit through the side frame 19 by the turbulent flow of catholyte. The high catholyte flow rate permits the omission of a space-consuming and costly cooling chamber or plate within the cell 10 and still permits the cell 10 to be operated with the catholyte maintained at a temperature of less than about 50° C.

Returning now to FIG. 2, it is seen that the catholyte end box 12 has a cover plate 18 that is retained in place by the retaining bolt 17. The side frame 19 has an upper portion that has machined therein a groove 25 in which is placed an O-ring 26 to accomplish sealing against the anode and frame member 30. A gasket 24 is placed between the cell top cover 18 and the upper side frame portion 19. The lower portion of the side frame 19 is retained in place against the cell bottom 11 by frame cap screw 23. An inwardly angled or sloped side frame dam portion 21 helps to retain the liquid metal cathode 22 in place and in combination with the catholyte flow pattern prevents its flowing out through the lower first inlet end 20. Cap screw 23 also secures a bottom frame support 27 to the cell bottom 11.

As previously indicated, the cell 10 is angled slightly from the horizontal over less than about a 5 percent grade, preferably less than about a 3 percent grade and most preferably about a 0.1 to about a 1 percent grade. The percent grade slope depends on the catholyte flow rate through the gap with a higher flow rate employing a greater percent grade slope. The cell slope is adjusted by a plurality of adjustment bolts (not shown) across the cell bottom. The catholyte average bulk flow velocity inside the cell 10 the gap 58 between the liquid metal cathode 22 and the membrane 51 is preferably between about 0.1 to about 1 meter per second calculated by cross sectional area and measured as an average of the flow permitted across the length of the approximately 4 meter long cell. Preferably the cell is tilted at an angle that is about a 0.275 percent grade. The catholyte flow thereby displaces the liquid metal in linear fashion by the uniform pressure drop of the flowing catholyte to obtain sufficient flow to clear any bubbles generated by the reaction off the membrane 51 and obtain the required mass transfer. The gas bubbles if left to build up, can create blockage or gas blinding of the membrane. The flow rate is sufficient, however, to not create sufficiently high velocity jets that create turbulence in the liquid metal cathode and carry that liquid metal cathode out of the cell. Although described hereinafter as being a flowing mercury cathode, it is to be understood that any type of flowing liquid metal cathode could be employed which has a high hydrogen overvoltage, including the use of such metals as bismuth and indium and alloys thereof.

Figure 4:
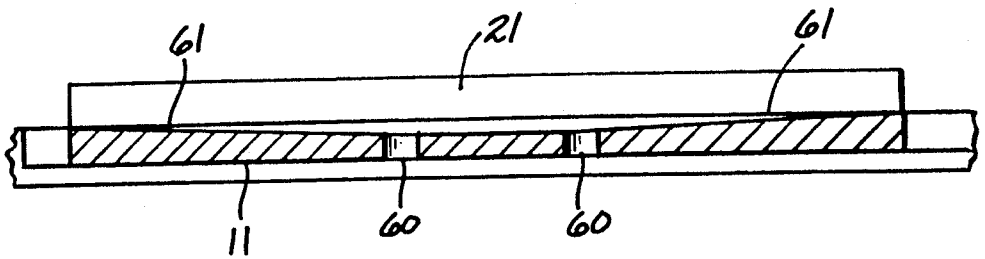
FIG. 4 is a sectional view along the line 4—4 of FIG. 1 showing the taper of the laterally extending drain canals toward the drain holes.
Figure 3:
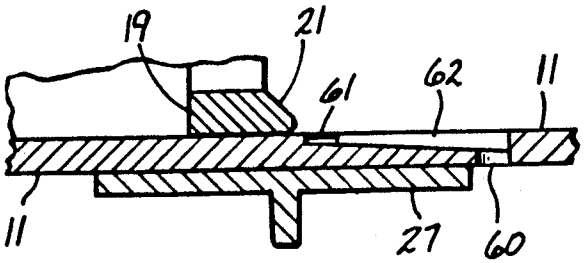
FIG. 3 is a partial sectional view taken along the lines of 3—3 of FIG. 1 showing the gradually inclined to increase in depth so as or angled slant of the drain canal toward a drain hole.

FIG. 1 shows central drain hole 13 in cell bottom 11. Drain holes 60 are shown on the opposing ends of the cell bottom or baseplate 11. Lateral drain canals 61 extend from the opposing sides of the cell bottom 11 inwardly toward the center, increasing in depth as they move centrally. At their outermost portions, drain canals 61 are flush or almost tangent to the top surface of the cell bottom 11. Lateral drain canals 61 are best seen in FIG. 4 showing their gradually incline and downward slope to increase in depth from the opposing sides downwardly and inwardly toward the drain holes 60. The space between the drain holes 60, where more than one such drain hole in employed, can be angled from a high point to slope downwardly toward each drain hole 60 to promote complete drainage thereinto. The longitudinal drain canals 62 are best shown in FIG. 3 where one such drain canal is shown sloping downwardly from the lateral drain canal 61 toward the drain hole 60. The slope of the longitudinal drain canals 62 along the longitudinal length of the cell 10 relative to the cell bottom or baseplate 11 must be at least incrementally greater than the slope of the cell relative to the earth on which the cell stands. Thus configured, the cell bottom 11 can be employed regardless of which end is angled lower from the horizontal during operation. If desired, only one end of the cell bottom can have the drain canals 61 and 62 and the drain holes 60 therein. Also, a single or multiple drain hole 60 can be employed on the opposing ends.

Another advantage of the unitary design of the cell bottom 11 is shown in FIG. 1 where a single cell surface can be employed to cover the catholyte chamber and the floor of both the inlet end box 12 and the outlet end box 14. The floor of both of the end boxes 12 and 14 can be coated with a plastic material, such as PFA, that can be extended along the length of the cell beneath the opposing sides 66 to assist in protecting and sealing the cell 10.

As can be seen in FIG. 2, the anode end frame 30 is secured to a top clamping frame 32 via a frame retaining bolt 33 which employs a washer 34 and a gasket 31. The top clamping frame 32 sits atop the cell top 39, which is preferably formed of stainless steel with a PFA coating. The top clamping frame 32 is connected to a support beam 35 which employs an anode post securing frame 28 and a plurality of support L-shaped beams 36 across the top. The support beam 35 is fastened to the top clamping frame 32 via a beam retaining bolt 37 that employs a gasket 31 and a suitably sized hexagonal nut. L-shaped support beams 36 can have gussets 38 to add additional support to the structure atop of the cell top 39. Within the anode compartment, anode support cross members 49 support the anode top 48 which is connected to electrode lead-in posts 40 (only one of which is shown) that are connected to copper bus 47. The electrode lead-in post 40 passes through the L-shaped support beam 36 and is retained in place by washers 46 and hexagonal nuts 45. The lead-in post 40 connects to the cell top 39 via a retaining nut 41, a lug washer 42 and a gasket 44 to provide a liquid-tight seal that permits current to be electrically conducted through the lead-in post 40 and a conductor pad 43 to the anode.

Once the catholyte has flowed through the gap between the liquid metal cathode 22 and the membrane extended plane portion 51, it exits the cell through the opposing higher second outlet end 56 into the cathode outlet end box 14. There any gas such as hydrogen which was generated and removed as bubbles from the surface of the membrane, exits through the catholyte end box gas pipe 55, while the catholyte is recirculated and exits through the catholyte outlet 16.

The cell is clamped together by tie bolts (not shown). The stainless steel PFA coated anode side frames are sealed to the stainless steel PFA coated cell top 39 via GORETEX® gaskets 44 and to the membrane 51 via the use of EPDM O-rings placed in channels (not shown) within the side frames. The anode lead-in post 40 connects via conductor pad 43 to the anode top 48. GORETEX® gaskets (not shown) can be placed above and below the stainless steel PFA coated cathode side frame 19 to seal the membrane and the HASTELLOY-C cell bottom 11. Gaskets (not shown) may be used along the interior of the cathode side frames 19 to assist in sealing to the cell bottom 11.

Any gas, such as oxygen, generated within the anode chamber exits through the anolyte gas nozzle 52 of FIG. 2 that is connected to the cell top 39. The gas nozzle 52 can employ flanges 54 to retain multiple sections of the nozzle or pipe together.

Where hydroxylamine nitrate is the desired product to be produced, an aqueous solution of nitric acid is fed to the cathode compartment of the electrolytic cell 10. The aqueous solution may contain any concentration of $HNO_3$ which is suitable for electrolysis to produce hydroxylamine nitrate. Since nitric acid is a strong oxidizing agent, the catholyte solution in the cathode compartment should have a uniform or homogeneous concentration so that localized pH gradients can be controlled and high $NO_3^-$ levels do not lead to oxidation of the product. The catholyte solution is essentially free of other mineral acids, such as hydrochloric acid or sulfuric acid.

During electrolysis, the desired reactions at the cathode are thought to be as given in the following equations:

$$HNO_3+2H^++2e^-\rightarrow HNO_2+H_2O \quad (1)$$

$$HNO_2+4H^++4e^-\rightarrow NH_2OH+H_2O \quad (2)$$

(1) and (2) being summarized by $$HNO_3+6H^++6e^-\rightarrow NH_2OH+2H_2O \quad (3)$$

The hydroxylamine ($NH_2OH$) produced is then protonated for stabilization with $HNO_3$ according to the equation:

$$HNO_3+NH_2OH\rightarrow[NH_3OH]^+NO_3^- \quad (4)$$

While equations (3) and (4) are believed to indicate the stoichiometric amounts of nitric acid required to produce hydroxylamine nitrate during operation of the electrolytic process, an excess amount of nitric acid in the catholyte is maintained which is from about 0.1 to about 1.5, preferably from about 0.1 to about 0.8 and more preferably from about 0.2 to about 0.5 moles per liter.

In a preferred embodiment, the catholyte solution is continuously removed from and recirculated to the cathode compartment, following the supplemental addition of $HNO_3$ required to maintain the concentrations given above.

The catholyte solution temperature in the cathode chamber is maintained below about 50° C., for example, in the range of from about 5° to about 40° C., and preferably at from about 10° to about 25° C. If the temperature of the catholyte is above about 50° C. or if oxygen is present in the catholyte, the undesired formation of by-products such as nitrogen oxide, ammonia or nitrogen dioxide may occur, as represented by the equations:

$$NH_2OH\ HNO_3\rightarrow 2NO+2H_2O \quad (5a)$$

$$3NH_2OH\rightarrow NH_3+N_2+3H_2O \quad (5b)$$

$$4NH_2OH\rightarrow 2NH_3+N_2O+3H_2O \quad (5c)$$

The evolution of significant amounts of hydrogen gas is not desired. A preferred way to avoid this is to control the cathode half-cell potential. Suitable cathode half-cell potentials are those at about or below the hydrogen overvoltage for the cathode employed, for example, half-cell potentials in the range of from about −0.5 to about −3 volts versus a standard calomel electrode. Preferred cathode half-cell potentials are those in the range of from about −0.8 to about −2, and more preferably from about −1 to about −1.5.

When using a mercury cathode at half-cell potentials above about 3 volts, hydroxylamine nitrate may be reduced to ammonium nitrate according to the equation:

$$NH_2OH + HNO_3 + 2H^- + 2e \rightarrow NH_4^- + NO_3^- + H_2O \quad (6)$$

The concentration of the hydroxylamine nitrate in the catholyte is controlled to be between about 0.5 and about 5 molar, and more preferably between about 2 and about 4 molar.

The actual hydrogen overpotential of a cathode depends on many factors including current density, local pH gradient, temperature, the concentration gradients of the catholyte, and particularly in using mercury cathodes, on the degree of contamination of the mercury surface with metal impurities. Because of these various factors, and despite the fact that the generation of hydrogen also results in the production of $OH^-$ ions which can decompose hydroxylamine nitrate, some generation of hydrogen gas can be tolerated in the process of the present invention.

The anolyte is an aqueous mineral acid solution capable of supplying protons to the catholyte. Suitable mineral acids include nitric acid, hydrochloric acid, phosphoric acid, sulfuric acid, perchloric acid, boric acid, and mixtures thereof. Preferred as an anolyte is a nitric acid solution since it will not introduce undesired impurities into the catholyte. Where the purity of the hydroxylamine nitrate product is not critical, other acids such as hydrochloric or sulfuric may be used as the anolyte, providing they do not introduce sufficient amounts of the anion into the catholyte solution to form the corresponding hydroxylamine salt. Concentrations of the acid in the anolyte are not critical and any suitable concentrations may be used. It is advantageous to maintain the concentration of the anolyte solution higher than the concentration of the nitric acid catholyte solution to prevent dilution of the catholyte with water. For example, it is desirable to maintain a ratio of the molar concentration of the anolyte to that of the excess nitric acid in the catholyte of at least 2 and preferably from about 6 to about 15. The anolyte is preferably continuously removed from and recirculated to the anode compartment with the concentration of the acid being adjusted as required.

The cell 10 of the present invention is operated at current densities suitable for Producing concentrated solutions of hydroxylamine nitrate. For example, suitable cathode current densities include those in the range of from about 0.05 to about 10, preferably from about 0.2 to about 6, and more preferably from about 1 to about 4 kiloamperes per square meter.

Hydroxylamine nitrate solutions produced by the process of the present invention are of high purity. Hydroxylamine nitrate is however less stable than other hydroxylamine salts particularly at high temperatures. It is particularly important where the product solutions are to be concentrated, such as for example, where they use in a propellant, to carefully control the concentration of excess nitric acid in the product solution. This can be accomplished in one of several ways described in U.S. Pat. No. 4,849,073, assigned to the assignee of the present invention, and specifically incorporated by reference herein.

Materials of construction of the cell 10 are generally as described. The cell bottom can employ Hastelloy C alloy, while other parts of the cell not previously specified can employ either steel or stainless steel 304 where the parts are not wetted and either coated steel or coated stainless steel 316 where they are wetted by fluids in the process. The coating should be a material that is not reactive with the process fluids, such as PFA, PVC or CPVC. Where hydroxylamine nitrate is not the product, other materials of construction compatible with the process would be employed.

In order to exemplify the results achieved with the use of the process and the cell of the instant invention, the following example is provided without any intent to limit the scope of the instant invention to the specific discussion therein.

EXAMPLE

A 4 meter long pilot scale electrolytic cell of the design shown generally in FIG. 2 is operated with a NAFION® 417 reinforced membrane, CPVC cell top and anode side frames, and PVC cathode side frames. The cell bottom employed Hastelloy® C alloy material. The cell is operated at about 1.5 kiloamperes per square meter at a catholyte temperature of about 10° C. The amperage is gradually increased from the initial 300 amps to about 450 amps and the cell is operated at a catholyte temperature of about 15° C.

A triple distilled mercury pool is utilized as the cathode. Electrical connection is made between the copper bus and the cathode. The anode assembly consists of platinum-clad niobium mesh welded to 51 niobium blades that are welded in turn along the length of the niobium support channel's underside. Platinum is coated in the desired amount per square inch of mesh and a niobium boss is welded to each end of the channel's topside. A niobium post is screwed into each anode boss to provide the electrical connection between the anode and the copper bus. 60-mil GORTEX® gasket seals were employed to seal the anode and cathode side frames. The anode side frame used EPDM O-ring seals in addition to the gaskets. The two clamping frames is bolted together with 26 tie bolts to provide the proper sealing pressure.

Catholyte is fed into the catholyte inlet header and then is dispersed evenly over the cathode surface through 8 evenly spaced holes or inlet passages in the side frame. The catholyte exits in the gap between the membrane and the cathode through the outlet passages into the outlet end box where gas is vented out through the top of the end box, product overflows into a product line, and recirculating catholyte is returned via a heat exchanger and a static mixer for reconcentration with fresh nitric acid to the cell. The product is gravity fed into a product drum. The product is filtered prior to being fed into the drum. The catholyte is cooled by an external cooling system utilizing a single-pass, polytetrafluorethylene heat exchanger through which catholyte and about a 50% chilled glycol solution is passed countercurrently.

About 70% nitric acid is meter pumped from a storage tank into a static mixer inlet and quickly mixed with the recycled catholyte. Anolyte is pumped through the cell and into an overflow anolyte reservoir, passing perpendicularly to the catholyte direction of flow. The anolyte water is electrolyzed at the anode during operation and is electro-osmotically transported into the catholyte. The anolyte contains about 6 to about 7 molar nitric acid that provides a concentration gradient supporting osmotic water transport from the catholyte to the anolyte to minimize catholyte dilution. The anode compartment and anolyte tank are vented to the atmosphere.

The opposing second higher outlet end passage from the catholyte end frame is elevated about 7 millimeters higher than the first inlet end passage.

Representative catholyte and anolyte pressures during operation of the cell would be expected to be about 14 to about 16 Kilopascals (KpA) catholyte pressure and about 8 KPA anolyte pressure. The differential pressure is measured across the membrane and is expected to be about 50 to about 90 centimeters of water or about 0.7 to about 1.3 pounds per square inch.

While the invention has been described above with reference to specific embodiments thereof, it is apparent that many changes, modifications and variations in the materials, arrangements of parts and steps can be made without departing from the inventive concept disclosed herein. For example, in employing the electrolytic cell design of the present invention, while the anolyte has previously been described as being circulated, it is not necessary to have the anolyte circulated as long as the concentration is periodically checked to ensure constant operating conditions. The anolyte need not be just an aqueous mineral acid, but could be any appropriate hydrogen ion containing electrolyte. Also, the process and cell disclosed herein can be used in any electrochemical process that requires the combination of reduction on a liquid metal cathode and a cation that is released at the anode and transported by the membrane into the catholyte where it is used in the reaction. Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

Having thus described the invention, what is claimed is:

1. An electrolytic cell having opposing sides and ends and a flowable liquid metal cathode, an anode and a membrane with a major portion thereof positioned in an extended plane therebetween, the membrane and a top surface of the liquid metal cathode defining a gap in a cathode compartment through which catholyte flows from an inlet end to an opposing outlet end of the cell, the improvement comprising:

a cell baseplate extending from the inlet end to the opposing outlet end having at least one drain hole therethrough.

2. The cell according to claim 1 further comprising the at least one drain hole being in fluid flow communication with at least one lateral drain canal extending from the opposing sides of the cell inwardly, the at least one lateral drain canal being tangent to the surface of the baseplate closer to the opposing sides of the cell and increasing in depth nearer the drain hole.

3. The cell according to claim 1 further comprising at least one longitudinally extending drain canal that is sloped downwardly from the at least one lateral drain canal toward the at least one drain hole, the at least one longitudinally extending drain canal being connected to the at least one lateral drain canal.

4. The cell according to claim 3 further comprising the at least one lateral drain canal uniformly increasing in depth.

5. The cell according to claim 4 further comprising the at least one longitudinally extending drain canal increasing in depth from the at least one lateral drain canal to the at least one drain hole.

6. The cell according to claim 5 further comprising the cell being angled from the horizontal so that the inlet end is lower the the opposing outlet end.

7. The cell according to claim 6 further comprising the cell being angled from the horizontal on a grade of less than about 5 percent.

8. The cell according to claim 7 further comprising the cell being angled from the horizontal on a grade of less than about 3 percent.

9. The cell according to claim 8 further comprising the cell being angled from the horizontal on a grade of less than about 1 percent.

10. The cell according to claim 6 further comprising using a liquid metal cathode selected from the group consisting of mercury, bismuth and indium and alloys thereof.

11. The cell according to claim 10 further comprising the gap between the membrane and the liquid metal cathode between about 2 and about 30 millimeters.

12. The cell according to claim 11 further comprising the gap between the membrane and the liquid metal cathode between about 7 and about 15 millimeters.

13. The cell according to claim 12 further comprising the gap between the membrane and-the liquid metal cathode between about 7 and about 11 millimeters.

14. The cell according to claim 10 further comprising the membrane being generally parallel to the top surface of the liquid metal cathode.

15. The cell according to claim 14 further comprising the baseplate supporting the liquid metal cathode in a cathode compartment in the cell.

16. The cell according to claim 6 further comprising the at least one longitudinally extending drain canal in the cell base plate being at least incrementally sloped greater than the amount the cell is angled from the horizontal relative to earth.

17. The cell according to claim 16 further comprising the cell having inlet and outlet end boxes adjacent the inlet end and the outlet end, the cell baseplate extending continuously from and forming a continuous bottom for the inlet end box, the outlet end box and the cathode compartment.

18. The cell according to claim 17 further comprising the continuous bottom in at least the inlet end box and the outlet end box being lined with a catholyte-resistant material.

19. The cell according to claim 18 further comprising the catholyte-resistant material extending along the cell baseplate beneath at least the opposing sides.

20. The cell according to claim 19 further comprising the catholyte resistant material being plastic.

21. The cell according to claim 5 further comprising baseplate having at least one drain hole adjacent the outlet end of the cell.

22. The cell according to claim 21 further comprising baseplate having at least one drain hole adjacent the inlet end of the cell.

23. The cell according to claim 22 further comprising the baseplate having at least one drain hole intermediate the at least one drain hole adjacent the outlet end of the cell and the at least one drain hole adjacent the inlet end of the cell.

* * * * *